US011812238B2

(12) United States Patent
Schweiger et al.

(10) Patent No.: US 11,812,238 B2
(45) Date of Patent: Nov. 7, 2023

(54) IMPEDANCE MATCHING DEVICE, TRANSDUCER DEVICE AND METHOD OF MANUFACTURING AN IMPEDANCE MATCHING DEVICE

(71) Applicant: Fraunhofer-Gesellschaft zur Foerderung der angewandten Forschung e.V., Munich (DE)

(72) Inventors: Severin Schweiger, Dresden (DE); Sandro Koch, Dresden (DE); Mario Grafe, Dresden (DE); Nicolas Lange, Dresden (DE); Joerg Amelung, Dresden (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 139 days.

(21) Appl. No.: 17/088,352

(22) Filed: Nov. 3, 2020

(65) Prior Publication Data

US 2021/0051403 A1 Feb. 18, 2021

Related U.S. Application Data

(63) Continuation of application No. PCT/EP2019/061400, filed on May 3, 2019.

(30) Foreign Application Priority Data

May 4, 2018 (DE) ..... 102018206937.9

(51) Int. Cl.

| | |
|---|---|
| ***G10K 11/02*** | (2006.01) |
| ***H04R 3/00*** | (2006.01) |
| ***H04R 3/02*** | (2006.01) |

(52) U.S. Cl.
CPC ..... *H04R 3/02* (2013.01); *G10K 11/02* (2013.01)

(58) Field of Classification Search
CPC ... H04R 3/00; H04R 3/03; H04R 1/00; H04R 1/028; G10K 11/02; G10K 11/26; G10K 11/28
See application file for complete search history.

(56) References Cited

U.S. PATENT DOCUMENTS 4,672,591 A * 6/1987 Breimesser ..... B06B 1/067 310/326
5,511,296 A * 4/1996 Dias ..... G10K 11/02 29/25.35

(Continued)

FOREIGN PATENT DOCUMENTS

DE 10026584 A1 12/2001
DE 102008014120 A1 9/2009

(Continued)

OTHER PUBLICATIONS

Ergun, Arif, et al., "Capacitive Micromachined Ultrasonic Transducers: Theory and Technology", J. Aerosp. Eng., vol. 16, No. 2, 2003.

(Continued)

*Primary Examiner* — Thang V Tran
(74) *Attorney, Agent, or Firm* — Perkins Coie LLP; Michael A. Glenn

(57) ABSTRACT

An impedance matching device for matching a characteristic acoustic impedance includes an impedance matching body including a first side and an opposite second side. The (Continued)

impedance matching device is configured to match a characteristic acoustic impedance of a medium contacted on the first side to a characteristic acoustic impedance of a sound transducer contacted on the second side. The impedance matching body includes microstructures which have a structural extent of at most 500 nanometers along at least one spatial direction.

45 Claims, 7 Drawing Sheets

(56) References Cited

U.S. PATENT DOCUMENTS

| | | | | |
|---|---|---|---|---|
| 5,524,491 | A | 6/1996 | Cavalloni | |
| 5,553,035 | A * | 9/1996 | Seyed-Bolorforosh | B06B 1/0622 310/320 |
| 5,974,884 | A | 11/1999 | Sano et al. | |
| 6,307,302 | B1 * | 10/2001 | Toda | B06B 1/067 310/327 |
| 2002/0161301 | A1 | 10/2002 | Venkataramani et al. | |
| 2004/0124746 | A1 * | 7/2004 | Suzuki | G01F 1/662 310/326 |
| 2005/0234341 | A1 * | 10/2005 | Oliver | G10K 11/02 600/459 |
| 2013/0221805 | A1 | 8/2013 | Ogura et al. | |
| 2013/0293066 | A1 | 11/2013 | Tsuzuki et al. | |
| 2016/0155433 | A1 | 6/2016 | Siverson et al. | |
| 2016/0269833 | A1 * | 9/2016 | Norris | H04R 1/1016 |

FOREIGN PATENT DOCUMENTS

| | | | | |
|---|---|---|---|---|
| EP | 0572349 | A1 | 12/1993 | |
| EP | 1237148 | A2 | 9/2002 | |
| EP | 1298642 | A2 | 4/2003 | |
| EP | 1363269 | A2 | 11/2003 | |
| EP | 1416255 | A1 | 5/2004 | |
| EP | 1477778 | A1 | 11/2004 | |
| EP | 1084454 | B1 | 3/2016 | |
| JP | 2001045596 | A | 2/2001 | |
| WO | 9954784 | A1 | 10/1999 | |
| WO | 2009112025 | A2 | 9/2009 | |
| WO | WO-2013154077 | A1 * | 10/2013 | B29C 33/424 |

OTHER PUBLICATIONS

Feng, Guo-Hua, et al., "A spherically-shaped PZT thin film ultrasonic transducer with an acoustic impedance gradient matching layer based on a micromachined periodically structured flexible substrate", Sensors (Basel, Switzerland), vol. 13, No. 10, pp. 13543-13559, 2013, pp. 13543-13559.

Gururaja, T R, et al., "Piezoelectric Composite Materials for Ultrasonic Transducer Applications. Part II: Evaluation of Ultrasonic Medical Applications", IEEE Transactions on Sonics and Ultrasonics, vol. SU-32, No. 4, pp. 499-513, Jul. 1985, Jul. 1985, pp. 499-513.

Haller, M I, et al., "Micromachined Ultrasonic Materials", Ultrasonics Symposium, 1991, 1991.

Krauss, O, et al., "Experimental and theoretical investigations of SiO2-aerogel matched piezo-transducers", Ultrasonics, vol. 32, No. 3, pp. 217-222, 1994, pp. 217-222.

Lerch, Reinhard, et al., "Technische Akustik: Grundlagen und Anwendungen—Part 1 of 3", Berlin: Springer, 2009. Uploaded in 3 parts.

Li, Zheng, et al., "Broadband gradient impedance matching using an acoustic metamaterial for ultrasonic transducers", (eng), Scientificreports, vol. 7, p. 42863, 2017, p. 42863.

Manh, Tung, et al., "Microfabrication of stacks of acoustic matching layers for 15 MHz ultrasonic transducers", (eng), Ultrasonics, vol. 54, No. 2, pp. 614-620, 2014, pp. 614-620.

Pedersen, Peder C, et al., "Impedance-matching properties of an inhomogeneous matching layer with continuously changing acoustic impedance", The Journal of the Acoustical Society of America, American Institute of Physics for the Acoustical Society of America, New York, NY, US, vol. 72, No. 2, Aug. 1, 1982 (Aug. 1, 1982), pp. 327-335, XP001418079, ISSN: 0001-4966, Aug. 1, 1982, pp. 327-335.

Saffar, Saber, et al., "Determination of acoustic impedances of multi matching layers for narrowband ultrasonic airborne transducers at frequencies <2.5 MHz—Application of a genetic algorithm", Ultrasonics, vol. 52, No. 1, pp. 169-185, 2012, pp. 169-185.

Yano, Tsutomu, et al., "Range Finding and Surface Characterization Using High-Frequency Air Transducers", IEEE Trans. Ultrason., Ferroelect., Freq. Contr., vol. 34, No. 2, pp. 232-236, 1987, pp. 232-236.

* cited by examiner

IMPEDANCE MATCHING DEVICE, TRANSDUCER DEVICE AND METHOD OF MANUFACTURING AN IMPEDANCE MATCHING DEVICE

CROSS-REFERENCE TO RELATED APPLICATIONS

This application is a continuation of copending International Application No. PCT/EP2019/061400, filed May 3, 2019, which is incorporated herein by reference in its entirety, and additionally claims priority from German Application No. DE 102018206937.9, filed May 4, 2018, which is incorporated herein by reference in its entirety.

The present invention relates to an impedance matching device, to a transducer device having such an impedance matching device, to a system having a transducer device mentioned, and to a method of manufacturing an impulse response. The present invention further relates to characteristic acoustic impedance matching, and in particular to a system for matching a characteristic acoustic impedance.

BACKGROUND OF THE INVENTION

The characteristic acoustic impedance describes the resistance of a medium against the acoustic flow resulting from acoustic pressure being applied. At interfaces of materials with different characteristic acoustic impedances, reflection occurs of part of the acoustic energy, the proportion of which is mainly caused by the size of the acoustic impedance jump. As a result, the energy that may be transferred between the sound transducers and the acoustic load medium is reduced and the efficiency of the system is lowered. Typical sound transducers with corresponding characteristic acoustic impedances are based on piezoceramics (characteristic acoustic impedance about 33 MRayl=33 Ns/m$^3$ [1]) or piezocomposites (about 7 MRayl [2]). Further typical sound transducers are based on piezo thin film systems and diaphragm oscillators, such as CMUT (capacitive micromachined ultrasonic transducers), whose characteristic acoustic impedances depend on the structural dimensions (about 1 to 5 MRayl [3]). Typical load media are water (1.48 MRayl [4]), human tissue (about 1.5 MRayl [4]) and air (about 427 Rayl [1]). For optimized energy transfer, especially in air, acoustic matching layers are essential.

Typically, layer systems for matching the characteristic acoustic impedance are made of conventional or composite materials with the best possible characteristic acoustic impedance. The characteristic acoustic impedance Z depends on the density ρ and on the sound velocity c of the material:

$$Z=c\rho$$

FIG. 9 shows three different methods of matching the characteristic acoustic impedance. So-called single step matching systems (SMS) place an impedance step between the ultrasonic transducer side (like CMUT) and the medium side (load). Multiple step matching systems (MMS) consist of two or more impedance steps. Gradient matching systems (GMS) describe an exponential impedance curve that provides the best transmittance. FIG. 9 shows a graph where a curve of the thickness D of the matching layer between a CMUT (D=0) and the load side or medium side (D=max) is plotted on the abscissa. The ordinate shows the characteristic acoustic impedance Z, which is reduced between the CMUT and the medium in the present diagram.

This curve also shows that the influence of the characteristic acoustic impedance on the transmittance increases the closer you get to the medium side within the matching layer system. In the above example, the matching layer system is expected to therefore achieve the lowest possible characteristic acoustic impedances, which cannot be achieved with known concepts or only in combination with major disadvantages. Aerogels [5] offer an approach to a solution. They achieve very low characteristic acoustic impedance, but have a highly diffractive effect and may only be applied in individual steps (MMS) with temporarily stored connecting materials, which in turn interfere with the transmission behavior. Composite materials consisting of embedded particles in a matrix have similar disadvantages [6].

There are a variety of microstructured materials manufactured by using methods from semiconductor industry. These methods include coating processes, structuring by means of lithography and etching processes. For example, these three processes have been used to provide characteristic acoustic impedance matching to structure silicon oxide on a silicon wafer. Subsequently, a polymer was applied by means of a coating process and fixed to an ultrasonic transducer [7]. In another example, anisotropic etching processes were used to separate silicon into high aspect ratio posts and then fill the interstices with epoxy resin (composite) to provide characteristic acoustic impedance matching [8]. A gradual progression is possible with the methods mentioned above. In one example, round, conically tapering silicon rods were produced and then embedded in epoxy resin [9]. Another example of gradual characteristic acoustic impedance matching uses unspecified micromachining techniques to produce a structured layer system of copper, PZT (lead zirconate titanate) and parylene [10].

However, the structures produced with the known methods exhibit low efficiency.

Therefore, it would be desirable to have characteristic acoustic impedance matching devices that enable characteristic acoustic impedance matching with high efficiency.

SUMMARY

According to an embodiment, an impedance matching device for matching a characteristic acoustic impedance may have: an impedance matching body having a first side and an opposite second side, the impedance matching device being configured to match a characteristic acoustic impedance of a medium contacted on the second side to a characteristic acoustic impedance of a sound transducer contacted on the first side; wherein the impedance matching body includes microstructures having structural extents of at most 500 nm along at least one spatial direction.

According to another embodiment, a transducer device may have: an impedance matching device as claimed for matching a characteristic acoustic impedance, which may have: an impedance matching body having a first side and an opposite second side, the impedance matching device being configured to match a characteristic acoustic impedance of a medium contacted on the second side to a characteristic acoustic impedance of a sound transducer contacted on the first side; wherein the impedance matching body includes microstructures having structural extents of at most 500 nm along at least one spatial direction; and a sound transducer element acoustically coupled, by acoustic coupling, to either the first side or the second side of the impedance matching body.

According to yet another embodiment, a system may have:

a transducer device, which may have:

an impedance matching device as claimed for matching a characteristic acoustic impedance, which may have:

an impedance matching body having a first side and an opposite second side, the impedance matching device being configured to match a characteristic acoustic impedance of a medium contacted on the second side to a characteristic acoustic impedance of a sound transducer contacted on the first side;

wherein the impedance matching body includes microstructures having structural extents of at most 500 nm along at least one spatial direction; and a sound transducer element acoustically coupled, by acoustic coupling, to either the first side or the second side of the impedance matching body; and a control unit configured to operate the sound transducer element.

According to yet another embodiment, a method of manufacturing an impedance matching device may have the steps of: providing an impedance matching body including a first side and an opposite second side and configured to match a characteristic acoustic impedance of a medium contacted on the first side to a characteristic acoustic impedance of a sound transducer contacted on the second side; so that the impedance matching body includes microstructures exhibiting structural extents of a maximum of 500 nm along at least one spatial direction.

According to still another embodiment, an impedance matching device for matching a characteristic acoustic impedance may have: an impedance matching body having a first side and an opposite second side, the impedance matching device being configured to match a characteristic acoustic impedance of a medium contacted on the second side to a characteristic acoustic impedance of a sound transducer contacted on the first side; wherein the impedance matching body includes microchannels having structural extents of at most 500 nm along at least one spatial direction; wherein the microchannels connect the first side and the second side with each other.

According to still another embodiment, an impedance matching device for matching a characteristic acoustic impedance may have: an impedance matching body having a first side and an opposite second side, the impedance matching device being configured to match a characteristic acoustic impedance of a medium contacted on the second side to a characteristic acoustic impedance of a sound transducer contacted on the first side; wherein the impedance matching body includes microchannels having structural extents of at most 500 nm along at least one spatial direction, wherein the microchannels connect the first side and the second side with each other; wherein the microchannels are branched microchannels, the number of which is monotonically variable between the first and second sides; and wherein the branched microchannels form cavities in the impedance matching body, wherein an effective material density of an impedance matching material of the impedance matching body is monotonically variable between the first side and the second side due to a monotonic increase or monotonic decrease of a volume of the cavities and causes matching of the characteristic acoustic impedance.

The inventors recognized that by forming microstructures with small dimensions in the sub-micrometer range, highly precise and, thus, efficient characteristic acoustic impedance matching may be performed.

According to one embodiment, an impedance matching device for matching characteristic acoustic impedance comprises an impedance matching body comprising a first side and an opposite second side. The impedance matching device is configured to match a characteristic acoustic impedance of a medium contacted on the second side to a characteristic acoustic impedance of a sound transducer contacted on the first side. The impedance matching body comprises microstructures which have structural extents of at most 500 nanometers along at least one spatial direction.

According to an embodiment, a method of manufacturing an impedance matching device comprises a step of providing an impedance matching body having a first side and a second opposite side and configured to match a characteristic acoustic impedance of a medium contacted on the first side to a characteristic acoustic impedance of a sound transducer contacted on the second side; such that the impedance matching body comprises microstructures having structural extents of at most 500 nm along at least one spatial direction.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
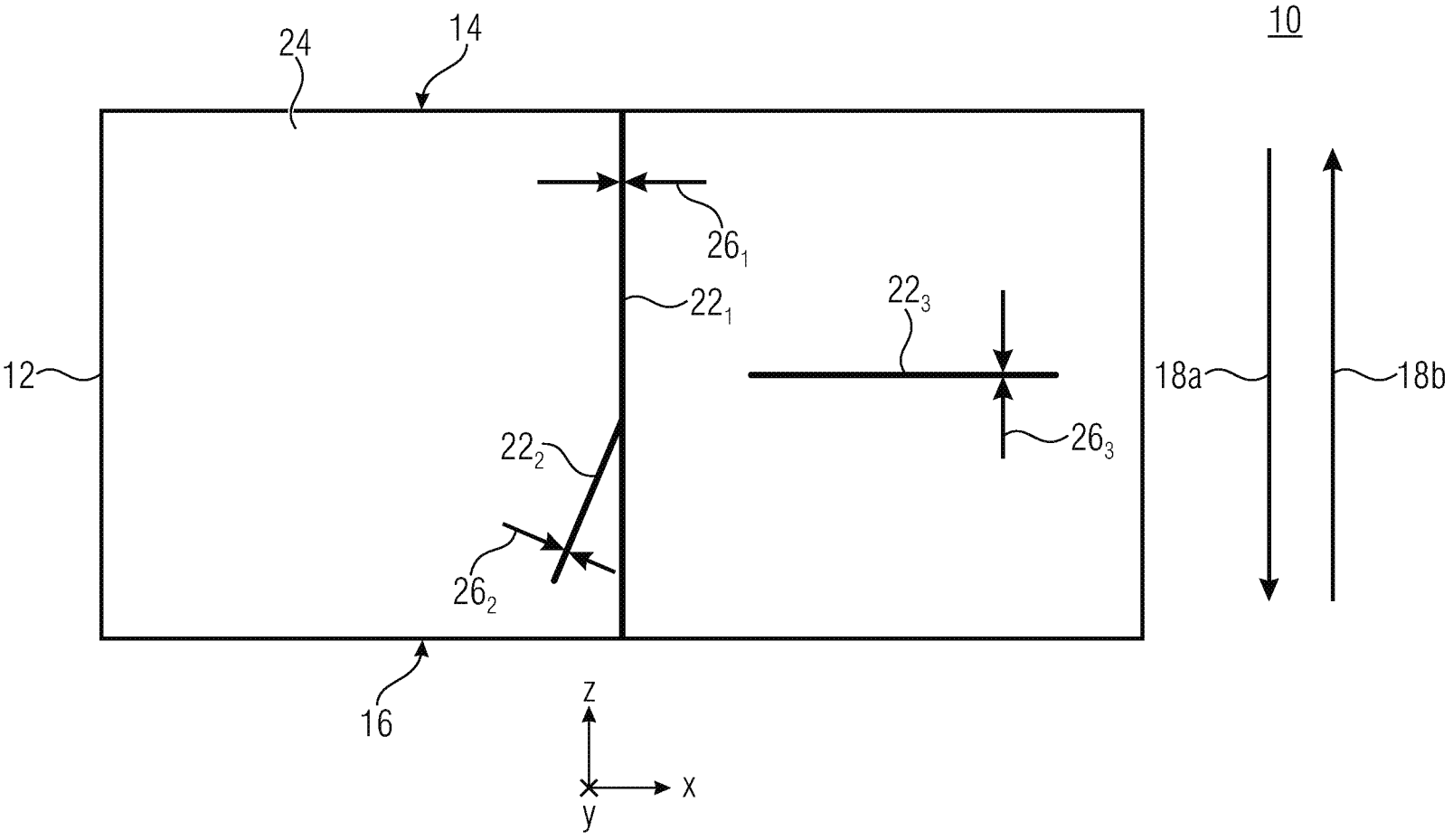
FIG. 1 shows a schematic block diagram of an impedance matching device for matching a characteristic acoustic impedance according to an embodiment.

Before the following embodiments will be explained in more detail by means of the drawings, it shall be pointed out that elements, objects and/or structures in the different figures which are identical, identical in function or in action are provided with the same reference numerals, so that the descriptions of these elements that are given in different embodiments are interchangeable or mutually applicable.

FIG. 1 shows a schematic block diagram of an impedance matching device 10 for matching a characteristic acoustic impedance. The impedance matching device comprises an impedance matching body 12 comprising a first side 14 and a second side 16. The sides 14 and 16 are arranged opposite each other. The impedance matching device may be configured to be traversed by a sound, i.e. an acoustic wave, from the side 14 to the side 16 along a sound propagation direction 18*a* and/or to be traversed by a sound wave from the side 16 to the side 14 along an opposite sound propagation direction 18*b*. For example, the sound wave may be generated by a sound transducer which may be contacted with the side 14. The side 16 may be contacted with a medium, for example a human body, a liquid or air or the like. The impedance matching device 10 may be configured to match a characteristic acoustic impedance of the medium to a characteristic acoustic impedance of the sound transducer, and/or vice versa. For this purpose, the impedance matching body 12 may, for example, have a characteristic acoustic impedance in a region of side 14 which is matched to the sound transducer, and may also have a characteristic acoustic impedance in the region of side 16 which is matched to the target medium.

As a result, the impedance matching body may have a higher characteristic acoustic impedance in the region of side 14 than in the region of side 16, although this is not necessary.

The impedance matching body 12 comprises microstructures, for example branched microstructures $\mathbf{22}_1$ and $\mathbf{22}_2$ and/or in-plane microstructures $\mathbf{22}_3$. The microstructures $\mathbf{22}_1$, $\mathbf{22}_2$ and/or $\mathbf{22}_3$ may be formed as cavities in a material of the impedance matching body 12, and the cavities may be filled or non-filled. A filling of the cavities may be completely or partially different in material from a base material or residual material 24 of the impedance matching body 12. This means that microstructures $\mathbf{22}_1$ to $\mathbf{22}_3$ may be understood to be cavities, channel structures and/or inclusions in the material 24.

The microstructures $\mathbf{22}_1$ to $\mathbf{22}_3$ may each be formed, individually or together, in such a way that they have, along at least one spatial direction, structural extents $\mathbf{26}_1$, $\mathbf{26}_2$ and/or $\mathbf{26}_3$ which are at most 500 nanometers, advantageously at most 300 nanometers and particularly advantageously at most 100 nanometers. The structural extent $\mathbf{26}_1$, $\mathbf{26}_2$ and/or $\mathbf{26}_3$ may be understood to be the longest distance between any two arbitrary points of an outer surface of the microstructure, the two arbitrary points being opposite each other in a cross section of the microstructure $\mathbf{22}_1$ to $\mathbf{22}_3$. The structural extents may be arranged along any spatial direction x, y and/or z. For example, if the microstructure is a tube-like structure, the points may be arranged in a longitudinal section or cross section, the longitudinal section extending, for example, through a plane formed by the diameter of the tube structure. In simplified terms, the structural extent of one or more microstructures may be a dimension thereof that is perpendicular to an axial extension direction of the respective microstructure. One idea of the present embodiments is to exploit the resolving power of a method described herein, which may be 100 nm or less, for example, so as to produce structures with high precision, i.e. with a high resolution.

Simply put, in such a case the structural extent may be the diameter of a round microstructure 22.

The microstructure $\mathbf{22}_2$ may be fluidically coupled to the microstructure $\mathbf{22}_1$, so that an average value of a volume occupied by microstructures $\mathbf{22}_1$ and $\mathbf{22}_2$ increases from side 14 towards the side 16, but may alternatively also decrease, i.e. an average value of the characteristic acoustic impedance may increase or decrease towards the side 14, or alternatively be constant, as described in connection with FIGS. 4*a* to 4*d*. This may cause a variable density ρ of the material 24 and, thus, a change in the characteristic acoustic impedance between the sides 14 and 16. If a material or a filling of the microstructures $\mathbf{22}_1$ and $\mathbf{22}_2$ has a material density higher than that of material 24, the characteristic acoustic impedance of the impedance matching device 10 may increase from side 14 towards the side 16. If, for example, the density is lower, a decreasing characteristic acoustic impedance may be obtained along the sound propagation direction 18*a*. This means that the microstructures may have a first impedance matching material, and that intermediate regions between the microstructures may have a second impedance matching material, for example material 24, arranged therein. The microstructures may be formed from a cured polymer material or a metal material, for example. Alternatively, any other material may be used. Described polymer materials and/or metal materials may be accurately processed and may thus be used directly as microstructures, as is described in connection with the manufacturing processes described herein. Alternatively, such structures may also serve as templates or negative molds to enable molding of other materials.

As an alternative to an arrangement that is parallel or oblique to a sound propagation direction 18*a* or 18*b*, at least one microstructure may also be arranged perpendicular thereto, for example in parallel with an x direction, which may be arranged perpendicular to a surface normal of the first side 14 and/or of the second side 16, for example.

By forming the microstructures with the defined structural extent of at most 500 nanometers, advantageously at most 300 nanometers or advantageously at most 100 nanometers, an extremely fine and, thus, exact adjustment of the characteristic acoustic impedance along the sound propagation direction 18*a* and/or 18*b* may be achieved. This allows efficient operation of the impedance matching device even with small dimensions of the impedance matching device 10.

Embodiments allow a continuous transition between the respective impedance values, for example the medium and the sound transducer, which cannot be implemented or can be implemented only with difficulty in known concepts. Embodiments provide concepts for an acoustic impulse response as well as their manufacturing processes, for example or even primarily while using the multiple photon absorption lithography process for producing layer systems which match the characteristic acoustic impedance between sound transducers and the medium. One goal is ideal coupling of the acoustic energy from the sound transducer into the load medium (transmission case) and/or from the load medium into the sound transducer (reception case).

Figure 2:
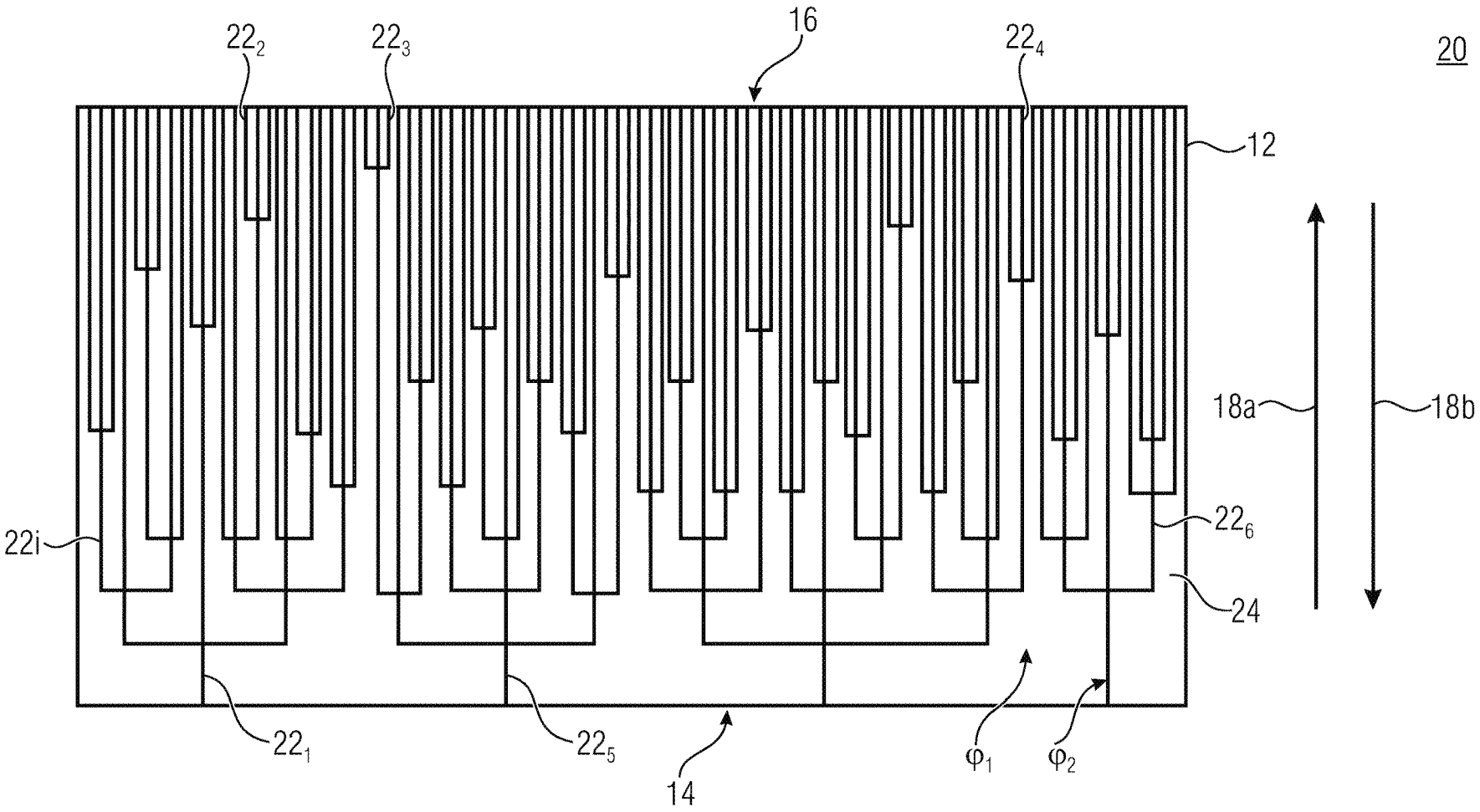
FIG. 2 shows a schematic sectional side view of an impedance matching device according to an embodiment, wherein a multitude of microstructures are arranged which are arranged as branched channel structures.

FIG. 2 shows a schematic sectional side view of an impedance matching device 20 according to an embodiment, wherein a multitude of microstructures $\mathbf{22}_i$ with i=1, . . . , 6, is arranged, which are arranged as branched channel structures between the sides 14 and 16, with a large number of more than 6 microstructures being arranged. Thus, for example, a single channel structure $\mathbf{22}_1$ may branch out into a multitude of channel structures in the region of side 14, for example in the sense of a river delta. A material or the absence of material may be described as at least a local material density $\rho_2$, which is different from a material density $\rho_1$ of the material 24.

The increasing volume fraction of the microstructures $\mathbf{22}_i$ enables a total density of the impedance matching body 10 that is increasingly influenced by the microstructures 22 along the sound propagation direction 18*a* and that may influence or determine the characteristic acoustic impedance and thus describes an increasing influence of such a material on the characteristic acoustic impedance.

The microstructures 22 may define cavities. An effective material density of the impedance matching body 12 may be monotonically variable between the sides 14 and 16 due to the cavities. The impedance matching material 24 with a density $\rho_1$ may be increasingly interspersed with the impedance matching material $\rho_2$, so that a variable effective density of the impedance matching body is obtained as a spatial average value. The monotonic increase or decrease of the volume of the microstructures may thus lead to a monotonic change of the density of the material 24 to cause matching of the characteristic acoustic impedance. The cavities may, for example, be formed or enclosed by the microstructures. Alternatively or additionally, at least one of the microstructures 22 may define an area outside a cavity, so that the cavity is formed away from the microstructures 22.

As illustrated in FIG. 2 by way of example, the microstructures 22 may define branched microchannels, the number of which varies monotonically between the sides 14 and 16, in order to effect the change in density of the material 24.

In other words, FIG. 2 shows microcavities that are formed in a layer system that is changed in terms of its effective density and, thus, characteristic acoustic impedance by cavities, channels or inclusions. The desired curve of the characteristic acoustic impedance may be generated by connected cavities 22. The largest number of channels and, thus, the lowest characteristic acoustic impedance may be arranged on the medium side of the layer system, i.e. on the side 16.

As an alternative or in addition to the number of microchannels, at least one other property such as the shape, position and/or volume of the microstructures may be variable to obtain the variable density or material density described in connection with FIG. 1. This change in density may be monotonous, as it may be obtained, for example, by the described monotonically variable number of microchannels. The change in all properties may be uniform, i.e., with an equal rate of change along the sound propagation direction. Alternatively, a variable rate of change may be established. The rate of change of one, several or all properties within the impedance matching body may be determinable, i.e., predeterminable, and may be implemented in an advantageous manner by appropriate acoustic calculations and/or simulations, which may enable a good or improved sound transmission. In examples, positional variance of the microstructures may result from the mutual distance ratio of the structures, or from the ratio of the positions of the structures in relation to one of outer walls of the impedance matching body. Thus, specific positioning of the structures in a concentrically changing manner may enable production of a focusing layer which exhibits no curvature of the outer walls. In examples, the impedance matching body may have a distance, decreasing from the center, in the direction of radiation between the individual structures.

As an alternative or in addition to shaping the microstructures as microchannels of equal or variable cross section, the microchannels may also have other shapes, such as spirals, round or non-round drops, cubes or the like. The microstructures may all be formed uniformly but also intentionally differently with regard to shape and/or size. Such a shape may refer to the microstructure as a whole, but combinations are also possible, such as a microchannel that forms or encompasses a drop, a round or non-round cavity or a cube, i.e., having polygonal surfaces, and/or a microchannel that extends in a spiral shape. A drop may be understood to be a non-linear and/or continuous change in cross section, one of the possible shapes being a sphere, which may also be longitudinally stretched, however. The shape may alternatively or additionally have a variable shape/cross section implemented along the, e.g., spiral shape and/or the exemplary spiral may be connected to further microstructures at at least one end or along a gradient. This is to be understood as an example only; one or more arbitrary shapes may be combined with one another.

Figure 3:
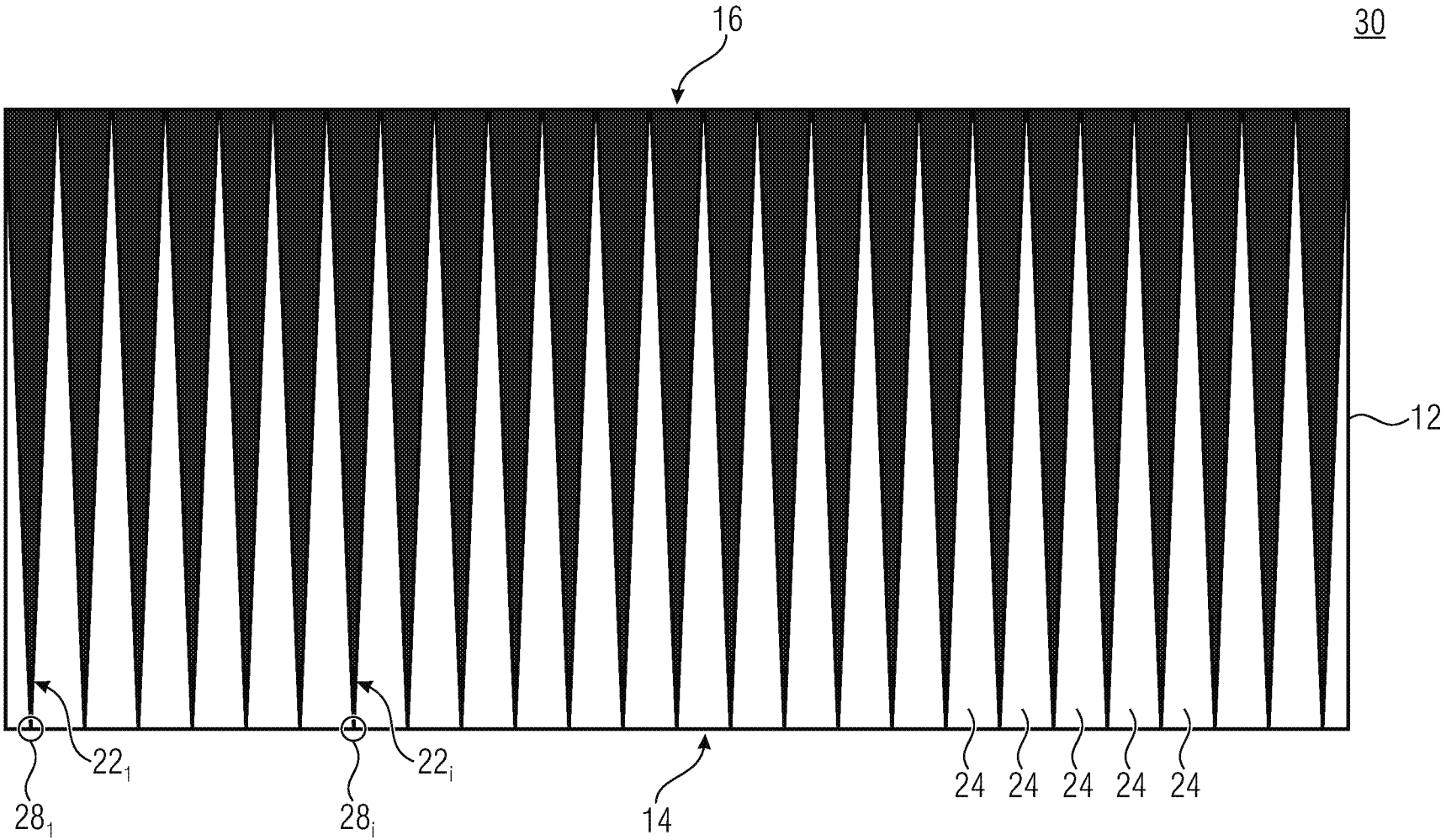
FIG. 3 shows a schematic sectional side view of an impedance matching device according to an embodiment, wherein the microstructures are formed as structures tapering towards one side of a matching body.

FIG. 3 shows a schematic sectional side view of an impedance matching device 30 according to an embodiment, wherein the microstructures are formed as structures tapering towards the side 14. The tapering structures may have areas $\mathbf{28}_i$ in a minimum extent, where the areas $\mathbf{28}_i$ of minimum extent are related to the structural extent. For example, the microstructures $\mathbf{22}_i$ may be tapered so that the areas 28 may represent the ends or tips of the conical structures. According to other embodiments, the microstructures are formed, individually or in combination, to be pyramid-shaped, conical or otherwise tapering, for example.

In other words, FIG. 3 illustrates an embodiment having tapering structures, wherein the main material 24 is subdivided into structures that are also conically tapered, and the material 24 may be tapered towards the side 16. The taper may start directly at the sides 14 or 16, but may alternatively be at a distance from these sides. The desired curve of the characteristic acoustic impedance is created, for example, by several conically tapering volumes of the microstructures $\mathbf{22}_i$. This may cause the lowest characteristic acoustic impedance of the impedance matching body to be located on the side 16.

While the embodiments according to FIG. 2 and/or FIG. 3 may be used as GMS matching structures, the microstructures 22 according to other embodiments may also be used as SMS and/or MMS.

Figures 4A, 4B, 4C, 4D:
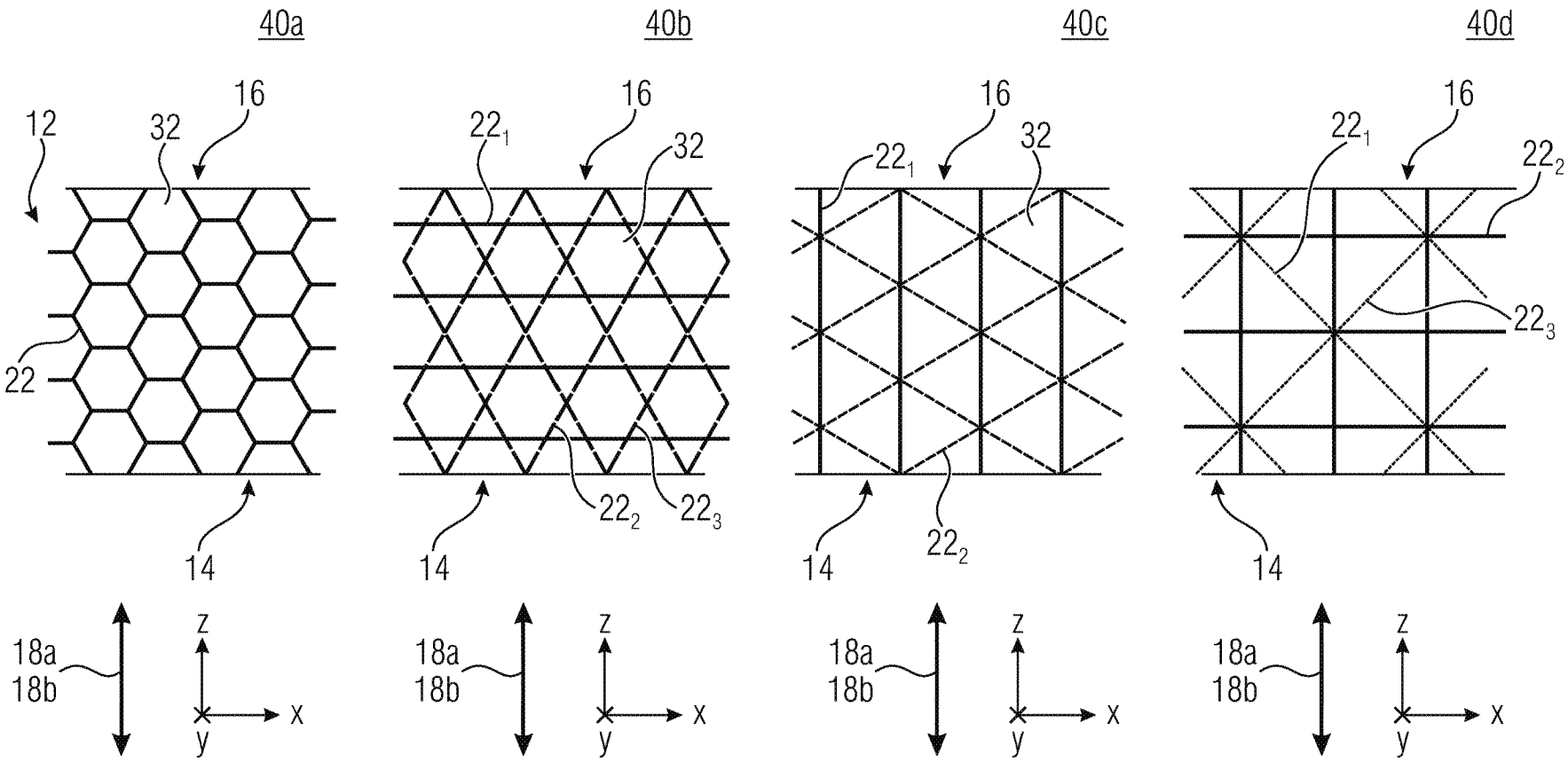
FIG. 4*a* shows a schematic sectional side view of an impedance matching device according to an embodiment, wherein the impedance matching body is formed such that the microstructures form a hexagonal lattice structure.
FIG. 4*b* shows a schematic sectional side view of an impedance matching device according to an embodiment, wherein the microstructures form a hexagonal/triangular pattern.
FIG. 4*c* shows a schematic sectional side view of an impedance matching device according to an embodiment, wherein the microstructures are arranged in a triangular lattice pattern so that cavities have a triangular shape.
FIG. 4*d* shows a schematic sectional side view of an impedance matching device according to an embodiment, wherein the microstructures form a lattice structure according to a diamond pattern.

FIG. 4*a* shows a schematic sectional side view of an impedance matching device 40*a*, wherein the impedance matching body is formed in such a way that the microstructures 22 form a lattice structure extending along a direction perpendicular to the sound propagation directions 18*a* and/or 18*b*. For example, within the impedance matching body 12 from the side 14 to the side 16 and vice versa, there is no change in the average density and/or the characteristic acoustic impedance. This means that the impedance matching body 12 may have a characteristic acoustic impedance which, on average, is unchanged or constant and which is, for example, lower than the higher one of the characteristic acoustic impedances arranged on the sides 14 and 16, and/or is higher than the lower one of said characteristic acoustic impedances. For example, the microstructures 22 in the side section shown may form a hexagonal lattice, or a honeycomb structure. According to an embodiment, the impedance matching device 40*a* enables an SMS.

FIG. 4*b* shows a schematic sectional side view of an impedance matching device 40*b* according to an embodiment, wherein the microstructures form a hexagonal/triangular pattern, for example by forming several in-plane microstructures, such as the microstructure $\mathbf{22}_1$ perpendicular to the sound propagation directions 18*a* and/or 18*b* and several microstructures arranged in different directions perpendicular thereto, which diagonally intersect the in-plane microstructure, either the microstructure $\mathbf{22}_2$ and/or $\mathbf{22}_3$, which extend in an oblique arrangement between the sides 14 and 16.

FIG. 4*c* shows a schematic sectional side view of an impedance matching device 40*c* according to an embodiment, wherein the microstructures are arranged in a triangular lattice pattern so that cavities 32 have a triangular shape in the sectional side view shown. The microstructures 22 may, for example, be formed from the material 24, and the cavities 32 may represent filled or unfilled cavities.

FIG. 4*d* shows a schematic sectional side view of an impedance matching device 40*d* according to an embodiment, wherein the microstructures $\mathbf{22}_1$ to $\mathbf{22}_3$ also form a lattice structure, the lattice structure being formed according to a diamond pattern.

The impedance matching devices 40*a*, 40*b*, 40*c* and/or 40*d* may have a substantially homogeneous or constant characteristic acoustic impedance between the sides 14 and 16. Embodiments provide for an impedance matching device to comprise an impedance matching body which is formed in several layers and comprises at least a first layer and a second layer, which are arranged to join each other. The first layer may have a first layer characteristic impedance, and the second layer may have a second layer characteristic impedance, the two layer characteristic impedances being equal, but advantageously different from each other. For this purpose, identical patterns as shown in FIGS. 4*a* to 4*d* may be used, for example on the basis of different opening cross sections of the cavities 32, and/or different patterns may be used, for example by arranging different impedance matching bodies 12.

According to FIGS. 4*a* to 4*d*, the microstructures 22 may form a lattice structure arranged along a direction perpendicular to the sound propagation directions and extending along this direction, for example along the x direction. The cavities 32 may extend along the same or a different direction perpendicular to the sound propagation directions 18*a* and 18*b* in the impedance matching body, for example along the y direction. The cavities may have a polygonal cross section based on an arrangement of the microstructures 22; alternatively, the cross section may be formed according to a free-form surface, be elliptical or even round.

In other words, FIGS. 4*a* to 4*c* show the implementation of a microlattice. Here, the matching layer system comprises a scaffold-like lattice with variable scaffold elements. The microlattices mentioned are shown as sectional images of different lattice structures in FIGS. 4*a* to 4*d*, where FIG. 4*a* shows a hexagonal lattice, FIG. 4*b* shows a hexagonal/triangular lattice, FIG. 4*c* shows a triangular lattice, and FIG. 4*d* shows a diamond lattice. The lattices may be arranged in lattice planes, which may extend, e.g., in parallel with the sides 14 and/or 16, and an impedance matching device may have one or more lattice planes. The desired curve of the characteristic acoustic impedance may be created by differently aligned and connected connecting pieces. The characteristic acoustic impedance may be further modified by changing the distances and/or lattice structures and/or connector thicknesses. The lattice structures may be two-dimensional or three-dimensional lattice structures. Three-dimensional lattice structures may be characterized by a change in the lattice constant and/or the thickness and shape of the connections. This allows a high stiffness as compared to tapering structures and/or easy processing by means of the method since the structure may be readily penetrated with a developer solution.

Figure 5:
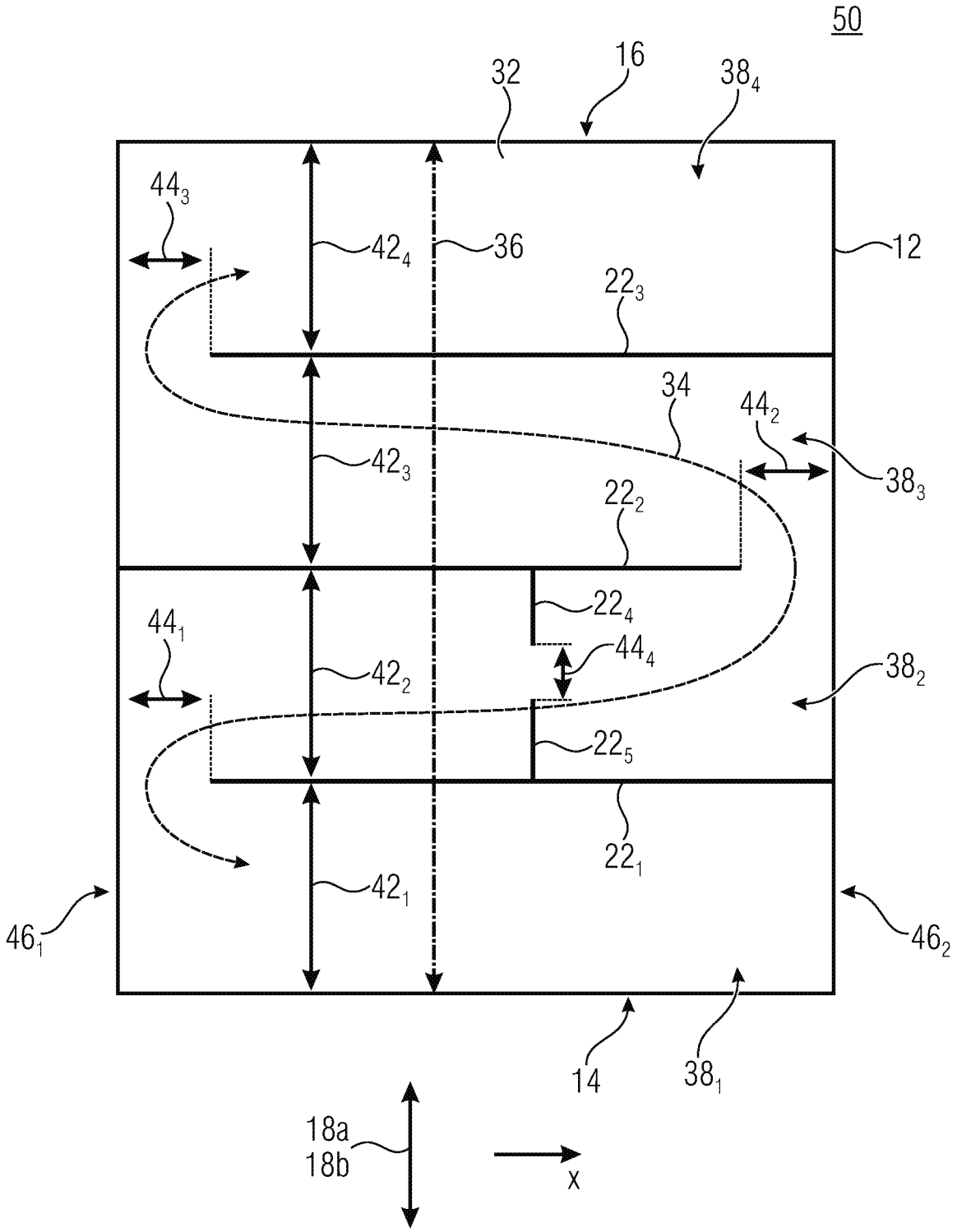
FIG. 5 shows a schematic sectional side view of an impedance matching device according to an embodiment, wherein the microstructures define an acoustic path.

FIG. 5 shows a schematic sectional side view of an impedance matching device 50 according to an embodiment, wherein the microstructures $\mathbf{22}_1$ to $\mathbf{22}_3$ define an acoustic path 34 between the sides 14 and 16. For example, the acoustic path 34 may pass through the cavity 32, which is defined by the microstructures $\mathbf{22}_1$ to $\mathbf{22}_3$. A vacuum, a fluid, for example a gas, and/or a solid may be located inside the cavity 32, and a material of microstructures $\mathbf{22}_1$ to $\mathbf{22}_3$ advantageously has a characteristic acoustic impedance higher than that of the impedance matching body 12 in a region of the acoustic path, for example of the cavity 32. Compared to a direct or shortest stretch 36 between the sides 14 and 16, the acoustic path 34 may provide a transit time prolongation for sound transmitted through the acoustic path 34. The transit time prolongation may be provided on the basis of a path extension as compared to the direct connection 36, i.e. the prolonged stretch, or path prolongation, of the acoustic path 34 may provide the transit time prolongation and, thus, a phase shift. According to an embodiment, the acoustic path 34 may have a plurality or a multitude of path sections $\mathbf{38}_1$ to $\mathbf{38}_4$. Although the impedance matching device 50 is represented in such a way that four path sections $\mathbf{38}_1$ to $\mathbf{38}_4$ are arranged in series, a different number of at least one path section, at least two path sections, at least three path sections, at least five path sections may be implemented, for example six, eight or ten path sections or more. With respect to one or more path sections, parallel path sections may also be arranged.

The path sections $\mathbf{38}_1$ to $\mathbf{38}_4$ may be arranged—individually, in groups or as a whole—perpendicularly to the sound propagation directions 18*a* and/or 18*b*, so that the acoustic path 34 in the region of the path sections $\mathbf{38}_1$ to $\mathbf{38}_4$ extends perpendicular to the sound propagation directions 18*a* and/or 18*b* or has at least one directional component that is perpendicular to the sound propagation directions 18*a* and/or 18*b*. The path sections may extend within different planes of the impedance matching body 12 between the sides 14 and 16, for example if the planes are considered as being parallel to the sides 14 and/or 16.

The path sections $\mathbf{38}_1$, $\mathbf{38}_2$, $\mathbf{38}_3$, and $\mathbf{38}_4$ may each have an acoustically effective cross section $\mathbf{42}_1$, $\mathbf{42}_2$, $\mathbf{42}_3$, and $\mathbf{42}_4$, respectively, which may be affected by the size or extent of the cavity 32 in the region of the respective path section $\mathbf{38}_1$ to $\mathbf{38}_4$. For example, the acoustically effective cross section $\mathbf{42}_i$ of a path section $\mathbf{38}_i$ may be determined or influenced by a distance of adjacent microstructures $\mathbf{22}_1$ and $\mathbf{22}_2$, $\mathbf{22}_2$ and $\mathbf{22}_3$ and/or a microstructure $\mathbf{22}_1$ or $\mathbf{22}_3$ on its side 14 or 16, respectively. The acoustically effective cross sections $\mathbf{42}_1$ to $\mathbf{42}_4$ may be identical to or different from one another, and, for example, an acoustic cross section that decreases along a sound propagation direction 18*a* or 18*b* may cause an increase in a characteristic acoustic impedance.

A taper $\mathbf{44}_1$, $\mathbf{44}_2$ and/or $\mathbf{44}_3$ of acoustic path 34 or of the acoustically effective cross section may be located between two possibly consecutive path sections $\mathbf{38}_1$ and $\mathbf{38}_2$, $\mathbf{38}_2$ and $\mathbf{38}_3$, and/or $\mathbf{38}_3$ and $\mathbf{38}_4$. Such a taper may be obtained, for example, by a distance between the microstructures and limiting structures $\mathbf{46}_1$ and/or $\mathbf{46}_2$, for example sidewall structures. Alternatively, it is also possible to provide a taper 44 between two adjacent microstructures 22, e.g. between the microstructures $\mathbf{22}_1$ and $\mathbf{22}_2$ to obtain a taper $\mathbf{44}_4$. Microstructures $\mathbf{22}_4$ and/or $\mathbf{22}_5$ may be provided for this purpose, and other materials and/or dimensions and/or geometries may also be used as long as these structures have an acoustic impedance higher than that of the cavity 32 in the region of the corresponding path section. Although the additional arrangement of the microstructures $22_4$ and $22_5$ involves a corresponding manufacturing effort, this allows accurate adjustment of the characteristic acoustic impedance of the impedance matching device 50. In contrast, the tapers $44_1$ to $44_3$ may be easily manufactured since they may result from a distance between the microstructures $22_1$ to $22_3$ from the limiting structures $46_1$ and/or $46_2$, for example.

According to an embodiment, an acoustically effective cross section $42_i$ of at least one path section $38_i$ may be variable over its axial extent, for example along the x direction. This may be obtained, for example, by a variable dimension of at least one of the microstructures $22_1$, $22_2$ and/or $22_3$ along the sound propagation direction 18*a* and/or 18*b*; alternatively or additionally, additional structures may be provided in the course of the path section $38_i$. The acoustically effective cross sections $42_i$ may be adjusted in the same way individually, in groups or as a whole. This means that acoustically effective cross sections of two adjacent path sections may be different from each other.

In other words, FIG. 5 shows a wound-up structure where the matching layer system consists of coiled-up or wound-up structures that increase the transit time of the sound wave. In FIG. 5, the wound-up structures are shown as a section through a unit cell of a layer system applied to a sound transducer. The desired curve of the characteristic acoustic impedance may be generated by several intertwined channels. Thus, the characteristic acoustic impedance may be influenced through the wave transit time via the speed of sound until the wave reaches the medium side of the layer system.

Embodiments illustrated above describe different designs of the microstructures in the impedance matching body. As it is shown, each of these embodiments may provide a single-stage, multi-stage or gradient-like curve of characteristic acoustic impedance matching. The different embodiments may be arbitrarily combined with one another, so that differently formed microstructures and/or lattice structures may be arranged within different planes perpendicular to the sound propagation direction and/or in parallel therewith. This may be effected in one piece, for example, by forming the microstructures differently in different regions of the impedance matching body. Alternatively, multi-piece arrangement may be effected, for example, in that impedance matching bodies according to different embodiments are mechanically and/or acoustically coupled and form a layer of a multilayer impedance matching body in each case.

By different implementations it is possible for a curve of the characteristic acoustic impedance between the first side 14 and the second side 16 of the overall impedance matching body obtained to be continuous or discontinuous. An example of a continuous curve may be a linear and/or exponential formation of the characteristic acoustic impedance along the sound propagation direction 18*a* and/or 18*b*.

Embodiments provide for the impedance matching device to be configured in such a way that the impedance matching body has different characteristic acoustic impedances on the different sides. For example, one of the sides may be matched to a characteristic acoustic impedance of an MUT sound transducer so that the characteristic acoustic impedance of the impedance matching body matches the characteristic acoustic impedance of the MUT sound transducer within a tolerance range of ±50%, ±25% or ±10%, i.e. the values of the characteristic acoustic impedance, the characteristic acoustic impedance values, match. An exemplary value for this is 1-35 MRayl. A range of 1-5 MRayl may well apply to diaphragm oscillators, which include MUT sound transducers. The range of 1-35 MRayl also includes ceramic and composite transducers, e.g. PZT-based transducer classes. Wherever possible, the characteristic acoustic impedance on the other side may match or at least approximate the characteristic acoustic impedance of a target medium, for example a fluid such as air.

Figure 6:
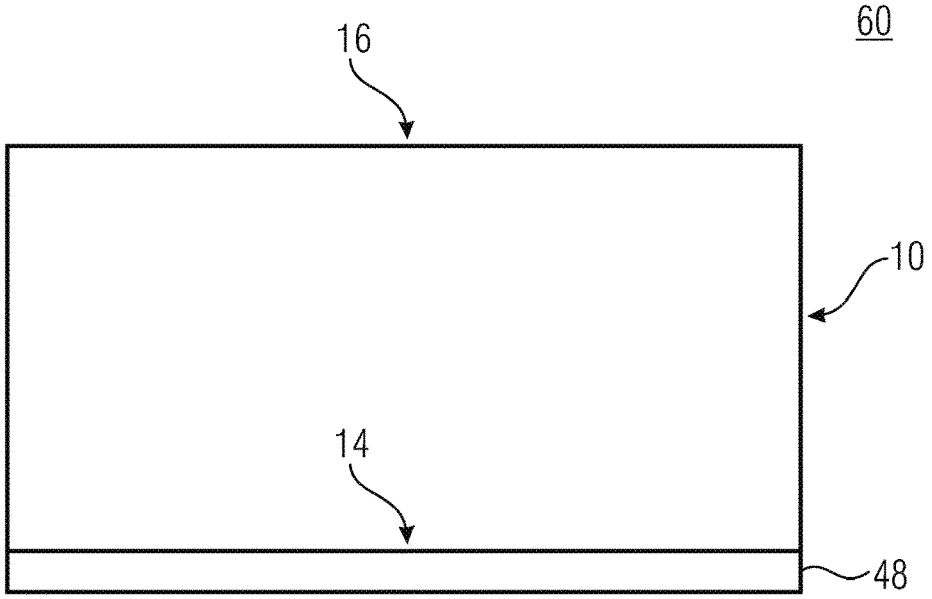
FIG. 6 shows a schematic block diagram of a transducer device according to an embodiment.

FIG. 6 shows a schematic block diagram of a transducer device 60 according to an embodiment. The transducer device 60 comprises, for example, the impedance matching device 10. The transducer device 60 further comprises a sound transducer element 48 which may be configured to generate a sound wave on the basis of a drive signal, and alternatively or additionally may be configured to provide an electrical signal on the basis of an incoming sound wave. This means that the transducer element 48 may be implemented as or include a sound actuator and/or sound sensor.

For example, the impedance matching device 10 is coupled to the sound transducer element 48 on the side 14, for example by having the impedance matching body mechanically firmly coupled to the sound transducer element 48. For example, the impedance matching device 10 may be deposited on the sound transducer element 48 or vice versa. Although transducer device 60 is described in such a way that sound transducer element 48 is acoustically coupled to the side 14, the sound transducer element 48 may alternatively be acoustically coupled to the side 16. The respective other side 16 or 14 may be configured to be contacted with a medium into which a sound wave is to be transmitted or from which a sound wave is to be received. Alternatively, a different acoustically effective structure, for example further sound transducer element, may be acoustically coupled to the other side, so that impedance matching between two sound transducer elements may be performed on the basis of the impedance matching device 10.

Advantageously, the acoustic coupling between the sound transducer element 48 and the side 14 has a continuous transition of the characteristic acoustic impedance, i.e. within the tolerance range of ±50%, ±25% or ±10%, the characteristic acoustic impedance of the sound transducer element 48 is in accordance with the characteristic acoustic impedance of the impedance matching device on the side 14.

The transducer element 48 may comprise a piezoelectric ceramic material and/or a composite material. In particular, the sound transducer element 48 may comprise a piezoelectric thin film material such as PVDF (polyvinylidene fluoride). According to one embodiment, the sound transducer element 48 comprises a micromachined ultrasonic transducer, for example a capacitive MUT (CMUT), a piezoelectric MUT (PMUT), or a magnetic MUT (MMUT).

Although the transducer device 60 is described in such a way that the impedance matching device 10 is arranged, a further and/or different impedance matching device may be arranged alternatively or additionally, for example the impedance matching device 10, 20, 30, 40*a*, 40*b*, 40*c*, 40*d* and/or 50. For example, impedance matching devices may be arranged which have a combination of different layers, each comprising at least one impedance matching device or impedance matching body, where, for example, an impedance matching device 40*a*, 40*b*, 40*c*, 40*d* may provide a layer of the common body comprising a characteristic acoustic impedance which is constant at least on the spatial average.

In other words, the described matching structures may be integrated, in an embodiment, on single and multi-channel, e.g. air-coupled, CMUT components and CMUT systems so as to increase the transducer range, sensitivity and bandwidth. Such systems may be optimized as miniaturized sensors for distance and motion detection as well as for imaging. Furthermore, they enable e.g. gesture control in vehicle interiors (automotive) and contactless control of household appliances (consumer), as well as sensor applications in medical technology and integration in mobile applications in service and industrial robots (industry).

Figure 7:
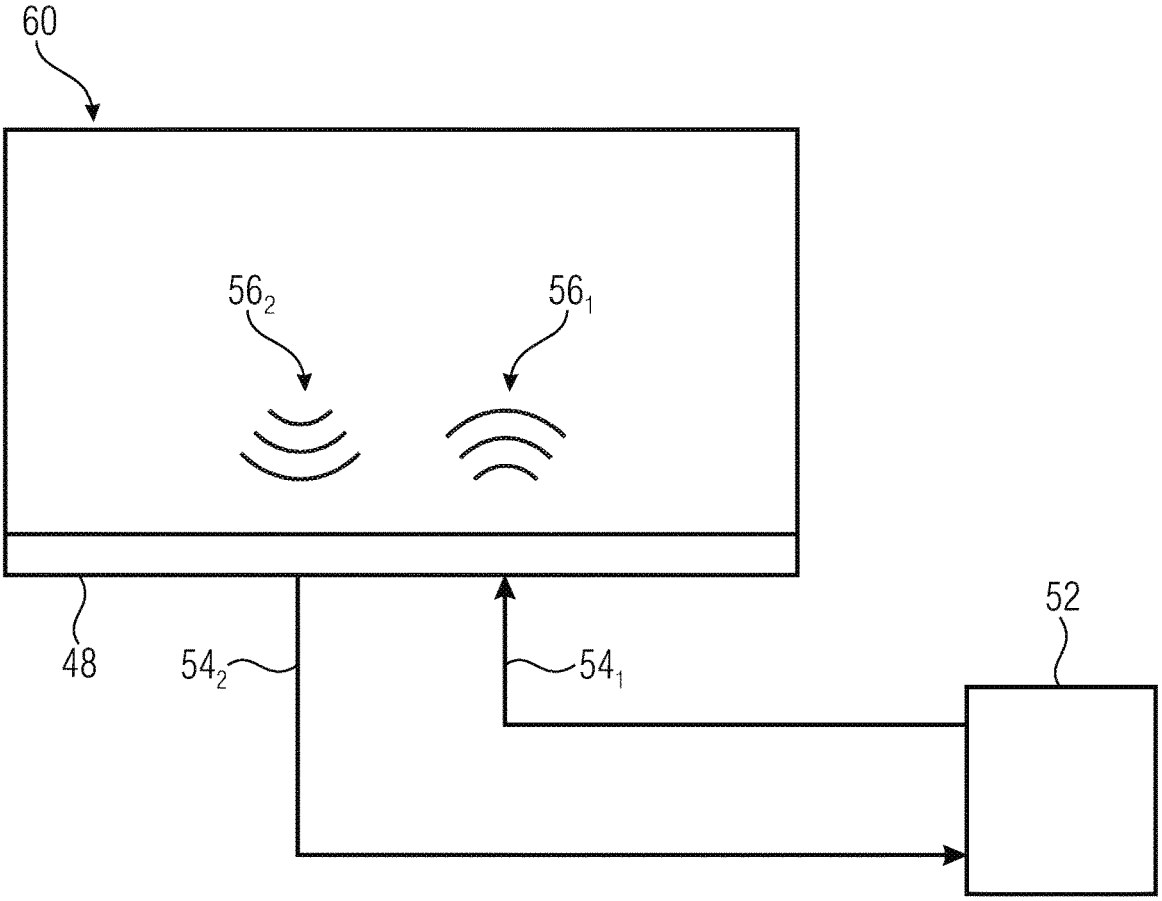
FIG. 7 shows a schematic block diagram of a system according to an embodiment.

FIG. 7 shows a schematic block diagram of a system according to an embodiment comprising, for example, the transducer device 60 and a control unit 52. The control unit 52 is configured to operate the sound transducer element 48, i.e. to provide a drive signal $\mathbf{54}_1$ to the sound transducer element 48 so as to excite the sound transducer element 48 to emit a sound wave $\mathbf{56}_1$ and/or to receive a sound transducer signal $\mathbf{54}_2$ from the sound transducer element 48 which provides the former on the basis of an incoming sound wave $\mathbf{56}_2$.

The control unit 52 may be configured to operate the sound transducer element 48 within an ultrasonic frequency range, that is, within a frequency range of at least 20 kilohertz. For example, the control unit may be configured to operate the sound transducer element 48 within a frequency range of at least 20 kilohertz and not more than 200 megahertz, at least 20 kilohertz and not more than 150 megahertz, or at least 20 kilohertz and not more than 100 megahertz.

Figure 8:
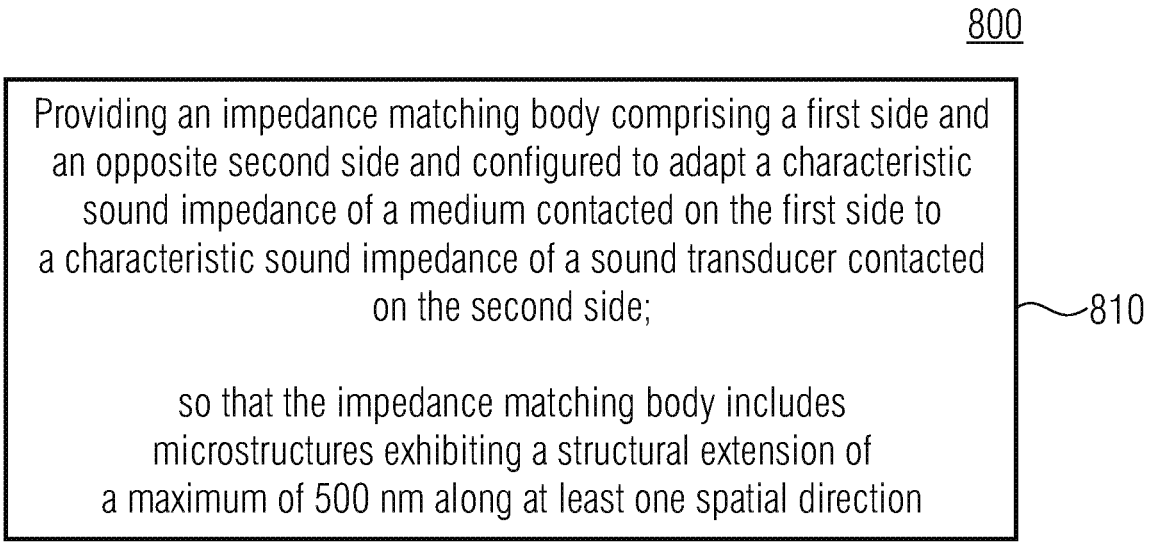
FIG. 8 shows a schematic flowchart of a method according to an embodiment of manufacturing an impedance matching device.
Figure 9:
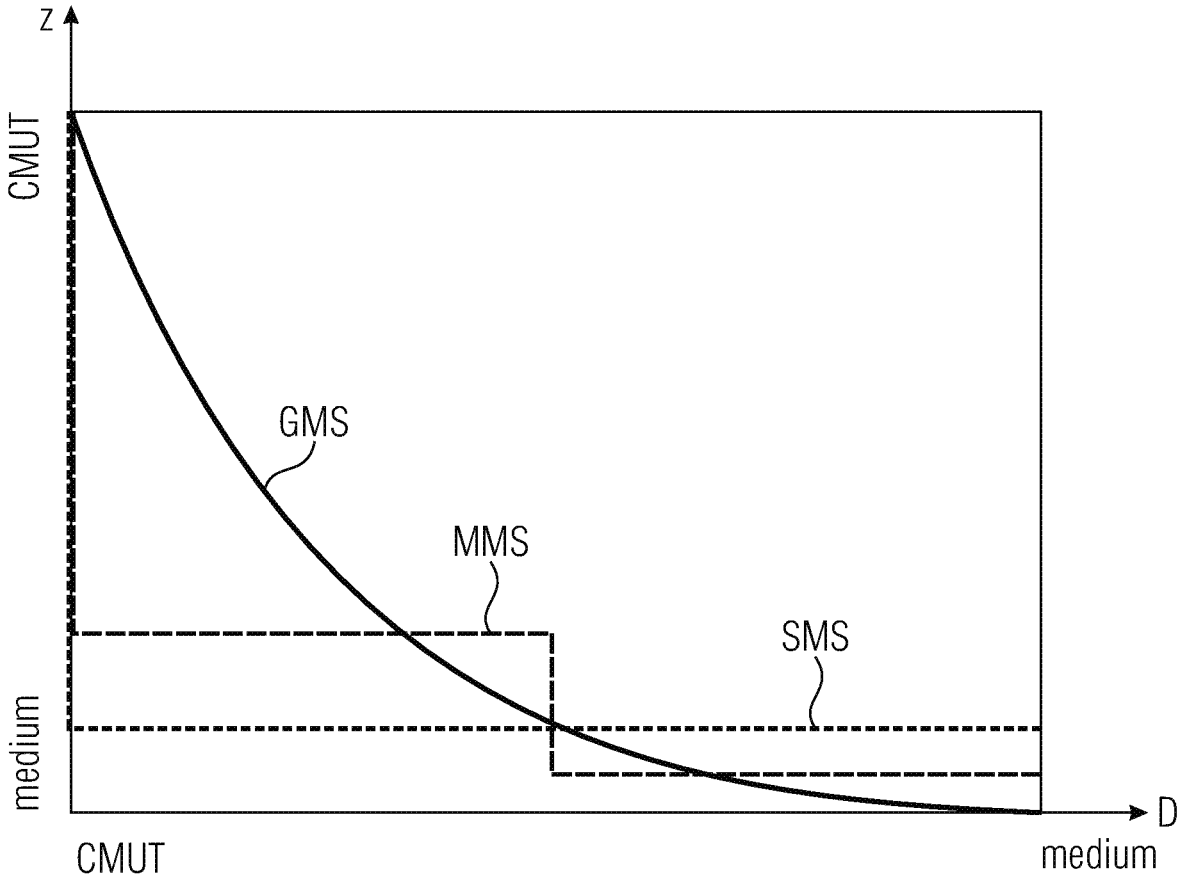
FIG. 9 shows a schematic representation of three known methods of matching the characteristic acoustic impedance.

FIG. 8 shows a schematic flowchart of a method 800, according to an embodiment, of manufacturing an impedance matching device, for example the impedance matching device 10, 20, 30, 40*a*, 40*b*, 40*c*, 40*d* and/or 50.

The method 800 comprises a step 810. Step 810 includes providing an impedance matching body comprising a first side and an opposite second side. The impedance matching body is configured to match a characteristic acoustic impedance of a medium contacted on the first side to a characteristic acoustic impedance of a sound transducer contacted on the second side, so that the impedance matching body comprises microstructures which have structural extents of at most 500 nanometers along at least one spatial direction.

For the method 800, the impedance matching body may be manufactured, for example, by placing it directly at or on top of a sound transducer or by manufacturing it as a separate component.

Manufacturing of the impedance matching body may include provision of a transfer material. In the transfer material, a positive or negative mold of the microstructures may be formed. According to an embodiment, the transfer material comprises a curable polymer material, in particular a polymer material that may be used in connection with multiple photon absorption lithography, for example SU-8 and/or Ormocer. The positive or negative mold may be produced by applying at least two photons to the transfer material at one location, so that a local change of a structural composition of the transfer material, i.e. curing or, alternatively, liquefaction of the polymer material is caused there. Multiple photon absorption lithography may provide structural sizes of at most 500 nanometers, at most 300 or at most 100 nanometers.

According to one embodiment, the transfer material comprises a metal material in which, for example, the positive mold or the negative mold of the microstructures may be obtained by an ablation process by means of multiple photon absorption, in particular a laser ablation process. However, the transfer material is not limited to a metal material but may also comprise a different material in a solid or liquid state for the (laser) ablation process by multiple photon absorption according to further embodiments and may comprise, for example, a fluid, e.g. a polymerizable fluid or a fluid in solid state, a semiconductor material, at least one organic compound and/or a ceramic material.

Microstructures comprising different materials may be combined with one another, so that utilization of a metal material as well as utilization of a polymer material as well as utilization of the fluid in a solid or liquid state and/or of the ceramic material in a solid or liquid state may be combined with one another in any way, for example in different layers of the impedance matching body.

The positive or negative mold that is obtained may be further processed. For this purpose, manufacturing may include, for example, a step of coating the positive or negative mold. Alternatively or additionally, inverting of the positive or negative mold may be performed. Inverting may be understood to be a material change of the positive or negative mold. For example, the positive or negative mold may be coated, then the material of the positive or negative mold may be dissolved out, for example by means of a solvent or an etching process, and then the cavity obtained may be refilled or filled with any material. The small structural sizes obtained by the multiple photon lithography process and/or laser ablation by multiple photon absorption may be retained, so that such small structural sizes may be produced even in materials that cannot be processed with such precision by subtractive methods, for example. Post-processing may also include casting of the positive or negative mold. Casting may be understood to be the transfer of a shape from the positive or negative mold to a corresponding different mold. Alternatively or additionally, the positive or negative mold may be encapsulated, in which, for example, the previously produced positive or negative mold is retained as the core. With reference to FIG. 3 as an example, the material 24 may, for example, be cured by a lithography process and be used as a positive mold, and filling with other materials is possible. Alternatively or additionally, e.g., the impedance matching body 30 may be obtained by providing cavities into which the material 24 is filled later. This means that manufacturing of the impedance matching body may include producing microstructures in such a way that they are formed as tapering microstructures, which is true both for the regions comprising the material 24 and for the spaces in between. According to one embodiment, manufacturing the impedance matching body may include producing at least one cavity that is located inside the impedance matching body and may cause a change in an effective density of the impedance matching body there. Producing a cavity may include both curing for subsequent retention of a material and extraction of a material, and describes, for example, the production of different materials and/or densities inside the impedance matching body on a spatial average for changing the density of the impedance matching body on the spatial average.

As described in the context of FIGS. 4*a*, 4*b*, 4*c*, and 4*d*, manufacturing of the impedance matching body may involve producing the microstructures as a lattice structure. The lattice structure may be formed from an impedance matching material of the impedance matching body and may define cavities extending along the direction perpendicular to the direction of sound propagation inside the impedance matching body. The cavities may, for example, have a polygonal cross section with three, four, five or six, seven or a higher number of corners and/or edges, the structures being combinable with each other. The microstructures in FIGS. 4*a*, 4*b*, 4*c*, and/or 4*d* may thus be formed from cured polymeric material and/or the metal material, but may also include a material that has been placed into a corresponding negative mold; the transfer material for defining these structures may be dissolved out later or may be retained.

According to one embodiment, manufacturing involves producing the microstructures such that the microstructures define an acoustic path between the sides of the impedance matching body, as described in the context of FIG. 5, for example. A material of the microstructures may have a characteristic acoustic impedance higher than that of the impedance matching body in a region of the acoustic path. The acoustic path may provide a transit time prolongation for sound transmitted through the acoustic path compared to a direct connection between the first side and the second side.

In other words, an approach of the present invention offers the advantage, especially as compared to known microstructures and methods for manufacturing same, of allowing three-dimensional structures of almost any shape and, above all, generous undercuts. According to one embodiment, the impedance matching body comprises an undercut, i.e. it comprises a mold comprising a section that would prevent removal from a casting mold or an impression mold. According to the manufacturing processes described, this is possible because any three-dimensional structures may be produced by means of the ablation and/or lithography processes.

An exemplary manufacturing process is described in EP 1 084 454 B1. A polymerization process using multi-photon absorption may be used, according to an embodiment, for the approach described for providing microstructures having specific characteristic acoustic impedances or curves of characteristic acoustic impedance. Processes described herein allow the producing structural sizes of at most 500 nanometers or less, for example at most 300 nanometers or at most 100 nanometers or less. The methods offer high flexibility in design and manufacturing of the microstructures for acoustic impedance matching.

The properties mentioned offer the advantage of generating precise, exponential characteristic sound curves, thus ensuring ideal coupling between the ultrasonic transducers and the load media. In addition, the high resolution (low structural extent) may be benefitted from for greatly reducing the characteristic acoustic impedance at short distances and, thus, to adapt to a medium such as air. Diffraction effects and other damping effects, as they are normally introduced by microstructures, may be reduced or even prevented by a specific design of the microstructures. A further advantage of the high precision is the possibility to produce a very precise layer system height, which has a strong influence on the transmission behavior. A further advantage is that intermediate and adhesive materials, which were used between individual impedance layers of different matching layers in previous solutions, may be dispensed with, although this does not exclude the possibility of providing them. This, however, eliminates their negative and unwanted influences on sound transmission and renders complex and labor-intensive deposition steps unnecessary. In principle, the described methods may be applied to any kind of sound transducers. Advantages are the precision that may be obtained especially with miniaturized sound transducer elements and transducer systems and that, thus contributes to added value especially with MEMS-based sound transducers, sound sensors and sound actuators.

Aspects of the embodiments described herein refer to the following features, among others:

1. System comprising an at least single-channel sound transducer and a characteristic acoustic impedance module for matching the acoustic impedance between a sound transducer and an ambient medium, characterized in that the characteristic acoustic impedance module has structural sizes below 500 nm.
2. System wherein the typical structural size of the characteristic acoustic impedance module is less than or equal to 100 nm.
3. System comprising a characteristic acoustic impedance module, characterized in that it has a homogeneous or inhomogeneous curve of the characteristic acoustic impedance.
4. System comprising a characteristic acoustic impedance module, characterized in that it has a homogeneous characteristic acoustic impedance between the transducer and the surrounding medium, advantageously with characteristic quantities of the characteristic acoustic impedance between that of the transducer and that of the surrounding medium, advantageously air.
5. System comprising a characteristic acoustic impedance module, characterized in that the layer system as in 2 consists of several layers of constant characteristic acoustic impedance, the characteristic acoustic impedance of the individual layers differing and advantageously having characteristic quantities between the characteristic acoustic impedances of the transducer and the medium, advantageously air.
6. System comprising a characteristic acoustic impedance module, characterized in that the characteristic acoustic impedance module has a linear curve of the characteristic acoustic impedance, advantageously with a continuous transition of the characteristic acoustic impedance between the transducer and the characteristic acoustic impedance module and between the characteristic acoustic impedance module and the load medium.
7. System comprising a characteristic acoustic impedance module, characterized in that the characteristic acoustic impedance module has an exponential curve of the characteristic acoustic impedance, advantageously with a continuous transition of the characteristic acoustic impedance between the transducer and the characteristic acoustic impedance module and between the characteristic acoustic impedance module and the load medium.
8. System characterized in that the sound transducer is operated as a sound actuator.
9. System characterized in that the sound transducer is operated as a sound sensor.
10. System characterized in that the sound transducer is operated both as a sound actuator and as a sound sensor.
11. System characterized in that the sound transducer operates in the ultrasonic frequency range, advantageously in the range between 20 kHz and 100 MHz.
12. System characterized in that the sound transducer is based on piezoelectric ceramics and composite materials, for example PZT.
13. System characterized in that the sound transducer is based on piezoelectric materials applied by thin film processing, for example PVDF.
14. System characterized in that the sound transducer is implemented as a micromachined sound transducer (MUT); advantageously with capacitive (CMUT), piezoelectric (PMUT) and magnetic (MMUT) operating principles.
15. Method of manufacturing a characteristic acoustic impedance module for matching the acoustic impedance between a sound transducer and an ambient medium, characterized in that the characteristic acoustic impedance module has structural sizes below 500 nm.

16. Method wherein the typical structural size of the characteristic acoustic impedance module is less than or equal to 100 nm.
17. Method characterized in that matching is carried out by creating microcavities and that the characteristic acoustic impedance module is changed in terms of its effective density, effective sound velocity and, thus, characteristic acoustic impedance by cavities, channels or inclusions.
18. Method characterized in that matching is carried out by creating tapering structures and that the characteristic acoustic impedance module is divided into several conically tapering volumes and consequently is changed in terms of its effective density, effective sound velocity and, thus, characteristic acoustic impedance.
19. Method characterized in that matching is carried out by creating microlattices and that the characteristic acoustic impedance module consists of framework-type lattices with variable framework elements, advantageously hexagons, hexagons/triangles, triangles and diamonds.
20. Method characterized in that matching is carried out by creating wound-up structures and that the characteristic acoustic impedance module consists of coiled-up or wound-up structures which increase the transit time of the sound wave.
21. Method using the multiple photon absorption lithography method of producing the characteristic acoustic impedance module, characterized in that a transfer medium changes its structural composition under the targeted action of at least two photons and produces a structure which is mechanically stable in comparison with the environment.
22. Method wherein the transfer medium consists of liquid and/or solid polymers, metals, gases, ceramics and/or combinations of these materials.
23. Method wherein the structures produced are reworked, advantageously by coating, inversion, casting and inclusions.

Even though some aspects have been described within the context of a device, it is understood that said aspects also represent a description of the corresponding method, so that a block or a structural component of a device is also to be understood as a corresponding method step or as a feature of a method step. By analogy therewith, aspects that have been described in connection with or as a method step also represent a description of a corresponding block or detail or feature of a corresponding device.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

[1] S. Saffar and A. Abdullah, "Determination of acoustic impedances of multi matching layers for narrowband ultrasonic airborne transducers at frequencies <2.5 MHz—Application of a genetic algorithm," Ultrasonics, vol. 52, no. 1, pp. 169-185, 2012.
[2] T. R. GURURAJA, WALTER A. SCHULZE, LESLIE E. CROSS, and AND ROBERT E. NEWNHAM, "Piezoelectric Composite Materials for Ultrasonic Transducer Applications. Part ii: Evaluation of Ultrasonic Medical Applications,"
[3] Ergun et al., "Capacitive Micromachined Ultrasonic Transducers: Theory and Technology," J. Aerosp. Eng, vol. 16, no. 2, 2003.
[4] R. Lerch, G. M. Sessler, and D. Wolf, Technische Akustik: Grundlagen and Anwendungen. Berlin: Springer, 2009.
[5] O. Krauß, R. Gerlach, and J. Fricke, "Experimental and theoretical investigations of SiOZ-aerogel matched piezotransducers," Ultrasonics, vol. 32, no. 3, pp. 217-222, 1994.
[6] T. Yano, M. Tone, and A. Fukumoto, "Range Finding and Surface Characterization Using High-Frequency Air Transducers," IEEE Trans. Ultrason., Ferroelect., Freq. Contr., vol. 34, no. 2, pp. 232-236, 1987.
[7] T. Manh, A.-T. T. Nguyen, T. F. Johansen, and L. Hoff, "Microfabrication of Stacks of acoustic matching layers for 15 MHz Ultrasonic transducers," (eng), Ultrasonics, vol. 54, no. 2, pp. 614-620, 2014.
[8] M. I. Haller and B. T. Khuri-Yakub, "Micromachined Ultrasonic Materials," Ultrasonics Symposium, 1991.
[9] Z. Li et al., "Broadband gradient impedance matching using an acoustic metamaterial for Ultrasonic transducers," (eng), Scientific reports, vol. 7, p. 42863, 2017.
[10] G.-H. Feng and W.-F. Liu, "A spherically—shaped PZT thin film Ultrasonic transducer with an acoustic impedance gradient matching layer based on a micromachined periodically structured flexible substrate," Sensors (Basel, Switzerland), vol. 13, no. 10, pp. 13543-13559, 2013.

The invention claimed is:

1. Impedance matching device for matching a characteristic acoustic impedance comprising:

an impedance matching body comprising a first side and an opposite second side, the impedance matching device being configured to match a characteristic acoustic impedance of a medium contacted on the second side to a characteristic acoustic impedance of a sound transducer contacted on the first side;

wherein the impedance matching body comprises microstructures comprising structural extents of at most 500 nm along at least one spatial direction wherein the microstructures are formed to comprise a first impedance matching material, wherein a second impedance matching material is disposed in intermediate regions between the microstructures; or wherein the impedance matching body is formed in several layers comprising at least a first layer comprising a first layer characteristic impedance and a second layer comprising a second layer characteristic impedance different from the first layer characteristic impedance.

2. Impedance matching device as claimed in claim 1, wherein the microstructures form microchannels which connect the first side and the second side with each other.

3. Impedance matching device as claimed in claim 1, wherein the microstructures define cavities, wherein an effective material density of an impedance matching material of the impedance matching body is monotonically variable between the first side and the second side due to the cavities and causes matching of the characteristic acoustic impedance;

wherein the microstructures define branched microchannels, the number of which is monotonically variable between the first and second sides, and wherein the microstructures form microchannels which connect the first side and the second side with each other.

4. Impedance matching device as claimed in claim 1, wherein the microstructures are formed to comprise an impedance matching material comprising a metal material, a semi-conductor material, an organic compound, a ceramic material or comprising a polymer material.

5. Impedance matching device as claimed in claim 1, wherein the structural extent of at least one microstructure is perpendicular to an axial direction of extension of the microstructures.

6. Impedance matching device as claimed in claim 1, wherein the microstructures define cavities, wherein an effective material density of an impedance matching material of the impedance matching body is monotonically variable between the first side and the second side due to the cavities and causes matching of the characteristic acoustic impedance.

7. Impedance matching device as claimed in claim 6, wherein the microstructures define branched microchannels, the number of which is monotonically variable between the first and second sides.

8. Impedance matching device as claimed in claim 6, wherein the microstructures between the first side and the second side are variable with respect to the shape of individual microstructures, the positions and/or the volumes of the individual microstructures.

9. Impedance matching device as claimed in claim 1, wherein at least one of the microstructures comprises at least one of a spiral shape, a drop shape, a cube shape or a channel shape.

10. Impedance matching device as claimed in claim 1, wherein the microstructures are formed as structures tapering towards the first side or towards the second side, and comprise the structural extent at least in a region of minimum extent.

11. Impedance matching device as claimed in claim 10, wherein the microstructures are conically tapered.

12. Impedance matching device as claimed in claim 1, wherein the microstructures form a lattice structure extending along a direction perpendicular to a sound propagation direction between the first side and the second side of the impedance matching body in the impedance matching body.

13. Impedance matching device as claimed in claim 12, wherein the lattice structure is formed of an impedance matching material of the impedance matching body and defines cavities extending along the direction perpendicular to a sound propagation direction in the impedance matching body, the cavities comprising a polygonal cross section.

14. Impedance matching device as claimed in claim 1, wherein the microstructures define an acoustic path between the first side and the second side, wherein a material of the microstructures comprises a characteristic acoustic impedance higher than that of the impedance matching body in a region of the acoustic path, wherein the acoustic path provides transit time prolongation for sound transmitted through the acoustic path as compared to a direct connection between the first side and the second side.

15. Impedance matching device as claimed in claim 14, wherein the acoustic path is formed as a folded structure comprising a plurality of path sections, the plurality of path sections extending perpendicularly to a sound propagation direction between the first side and the second side in the impedance matching body within different planes perpendicular to the sound propagation direction.

16. Impedance matching device as claimed in claim 15, wherein a taper of the acoustically effective cross section is disposed between a first path section of the plurality of path sections which comprises a first acoustically effective cross section and a second path section of the plurality of path sections which comprises a second acoustically effective cross section.

17. Impedance matching device as claimed in claim 15, wherein an acoustically effective cross section of at least one path section of the plurality of path sections is variable over its axial extension.

18. Impedance matching device as claimed in claim 15, wherein an acoustically effective cross section of a first path section of the plurality of path sections and an acoustically effective cross section of an adjacent second path section of the plurality of path sections are different from each other.

19. Impedance matching device as claimed in claim 1, wherein the microstructures are integrally formed at least within one layer of the impedance matching body.

20. Impedance matching device as claimed in claim 1, wherein the structural extent is at most 100 nm.

21. Impedance matching device as claimed in claim 1, wherein a curve of the characteristic acoustic impedance between the first side and the second side is continuous or discontinuous.

22. Impedance matching device as claimed in claim 21, wherein the curve of the characteristic acoustic impedance is exponential.

23. Impedance matching device as claimed in claim 1, wherein the impedance matching body comprises a first characteristic acoustic impedance value on the first side and a second characteristic acoustic impedance value on the second side, wherein either the first characteristic acoustic impedance value or the second characteristic acoustic impedance value matches a characteristic acoustic impedance value of a micromachined ultrasonic transducer, MUT, sound transducer within a tolerance range of ±50%.

24. Impedance matching device as claimed in claim 23, wherein the medium is air.

25. Impedance matching device as claimed in claim 1, wherein the impedance matching body comprises an undercut.

26. Transducer device comprising:

an impedance matching device as claimed for matching a characteristic acoustic impedance, comprising:

an impedance matching body comprising a first side and an opposite second side, the impedance matching device being configured to match a characteristic acoustic impedance of a medium contacted on the second side to a characteristic acoustic impedance of a sound transducer contacted on the first side;

wherein the impedance matching body comprises microstructures comprising structural extents of at most 500 nm along at least one spatial direction;

wherein the microstructures are formed to comprise a first impedance matching material, wherein a second impedance matching material is disposed in intermediate regions between the microstructures; or wherein the impedance matching body is formed in several layers comprising at least a first layer comprising a first layer characteristic impedance and a second layer comprising a second layer characteristic impedance different from the first layer characteristic impedance; and a sound transducer element acoustically coupled, by acoustic coupling, to either the first side or the second side of the impedance matching body.

27. Transducer device as claimed in claim 26, wherein the acoustic coupling comprises a continuous transition of the characteristic acoustic impedance.

28. Transducer device as claimed in claim 26, wherein the sound transducer element comprises a sound actuator and/or a sound sensor.

29. Transducer device as claimed in claim 26, wherein the sound transducer comprises a piezoelectric ceramic material and/or a composite material.

30. Transducer device as claimed in claim 26, wherein the sound transducer comprises a piezoelectric thin-film material, in particular a polyvinylidene fluoride material.

31. Transducer device as claimed in claim 26, wherein the sound transducer comprises a micromachined ultrasonic transducer, MUT, sound transducer.

32. System comprising:

a transducer device comprising:

an impedance matching device as claimed for matching a characteristic acoustic impedance, comprising:

an impedance matching body comprising a first side and an opposite second side, the impedance matching device being configured to match a characteristic acoustic impedance of a medium contacted on the second side to a characteristic acoustic impedance of a sound transducer contacted on the first side;

wherein the impedance matching body comprises microstructures comprising structural extents of at most 500 nm along at least one spatial direction;

wherein the microstructures are formed to comprise a first impedance matching material, wherein a second impedance matching material is disposed in intermediate regions between the microstructures; or wherein the impedance matching body is formed in several layers comprising at least a first layer comprising a first layer characteristic impedance and a second layer comprising a second layer characteristic impedance different from the first layer characteristic impedance; and a sound transducer element acoustically coupled, by acoustic coupling, to either the first side or the second side of the impedance matching body; and a control unit configured to operate the sound transducer element.

33. System as claimed in claim 32, wherein the control unit is configured to operate the sound transducer element within an ultrasonic frequency range.

34. Method of manufacturing an impedance matching device, comprising:

providing an impedance matching body comprising a first side and an opposite second side and configured to match a characteristic acoustic impedance of a medium contacted on the first side to a characteristic acoustic impedance of a sound transducer contacted on the second side;

wherein the impedance matching body comprises microstructures exhibiting structural extents of a maximum of 500 nm along at least one spatial direction wherein the microstructures are formed to comprise a first impedance matching material, wherein a second impedance matching material is disposed in intermediate regions between the microstructures; or wherein the impedance matching body is formed in several layers comprising at least a first layer comprising a first layer characteristic impedance and a second layer comprising a second layer characteristic impedance different from the first layer characteristic impedance.

35. Method as claimed in claim 34, wherein providing the impedance matching body comprises manufacturing same with the following:

providing a transfer material;

producing a positive mold or a negative mold of the microstructures in the transfer material.

36. Method as claimed in claim 35, wherein the transfer material is a curable transfer material, and wherein production of the positive or negative mold of the microstructures in the curable transfer material is performed by curing same while performing multiple photon absorption lithography which causes a local change in a structural composition of the curable transfer material.

37. Method as claimed in claim 35, wherein transfer material comprises a solid or liquid state and comprises at least one of a metal material, a semiconductor material, an organic compound, a ceramic material and a polymer material, a fluid and a ceramic material.

38. Method as claimed in claim 34, wherein providing the impedance matching body comprises manufacturing same with the following:

providing a transfer material;

producing a positive mold or a negative mold of the microstructures in the metal material by laser ablation by multiple photon absorption thereof.

39. Method as claimed in in claim 34, wherein providing the impedance matching body comprises manufacturing same with at least one of the following:

coating the positive mold or negative mold; and/or inverting the positive or negative mold; and/or pouring off the positive or negative mold; and/or encapsulating the positive or negative mold.

40. Method as claimed in claim 34, wherein providing the impedance matching body comprises manufacturing same, said manufacturing comprising producing at least one cavity in the impedance matching body to change an effective density of the impedance matching body.

41. Method as claimed in claim 34, wherein providing the impedance matching body comprises manufacturing same, said manufacturing comprising producing the microstructures such that they are formed as tapering microstructures.

42. Method as claimed in in claim 34, wherein providing the impedance matching body comprises manufacturing same, said manufacturing comprising producing the microstructures as a lattice structure, such that the lattice structure is formed of an impedance matching material of the impedance matching body and defines cavities extending along the direction perpendicular to a sound propagation direction in the impedance matching body, the cavities comprising a polygonal cross section.

43. Method as claimed in in claim 34, wherein providing the impedance matching body comprises manufacturing same, said manufacturing comprising producing one of the microstructures such that the microstructures define an acoustic path between the first side and the second side, such that a material of the microstructures comprises a characteristic acoustic impedance higher than that of the impedance matching body in a region of the acoustic path, such that the acoustic path provides transit time prolongation for sound transmitted through the acoustic path as compared to a direct connection between the first side and the second side.

44. Impedance matching device for matching a characteristic acoustic impedance comprising:

an impedance matching body comprising a first side and an opposite second side, the impedance matching device being configured to match a characteristic acoustic impedance of a medium contacted on the second side to a characteristic acoustic impedance of a sound transducer contacted on the first side;

wherein the impedance matching body comprises microchannels comprising structural extents of at most 500 nm along at least one spatial direction; wherein the microstructures are formed to comprise a first impedance matching material, wherein a second impedance matching material is disposed in intermediate regions between the microstructures; or wherein the impedance matching body is formed in several layers comprising at least a first layer comprising a first layer characteristic impedance and a second layer comprising a second layer characteristic impedance different from the first layer characteristic impedance;

wherein the microchannels connect the first side and the second side with each other.

45. Impedance matching device for matching a characteristic acoustic impedance comprising:

an impedance matching body comprising a first side and an opposite second side, the impedance matching device being configured to match a characteristic acoustic impedance of a medium contacted on the second side to a characteristic acoustic impedance of a sound transducer contacted on the first side;

wherein the impedance matching body comprises microchannels comprising structural extents of at most 500 nm along at least one spatial direction, wherein the microchannels connect the first side and the second side with each other;

wherein the microchannels are branched microchannels, the number of which is monotonically variable between the first and second sides; and wherein the branched microchannels form cavities in the impedance matching body, wherein an effective material density of an impedance matching material of the impedance matching body is monotonically variable between the first side and the second side due to a monotonic increase or monotonic decrease of a volume of the cavities and causes matching of the characteristic acoustic impedance.

* * * * *